US012565292B1

(12) United States Patent
Shepherd et al.

(10) Patent No.: US 12,565,292 B1
(45) Date of Patent: Mar. 3, 2026

(54) REINFORCED FAIRING APPARATUS AND METHOD FOR HYDRODYNAMIC DRAG AND VIBRATION REDUCTION

(71) Applicant: The United States of America, as represented by the Secretary of the Navy, Arlington, VA (US)

(72) Inventors: Stephen M Shepherd, Arlington, VA (US); Damien Bretall, Bethesda, MD (US)

(73) Assignee: The United States of America, as represented by the Secretary of the Navy, Washington, DC (US)

( * ) Notice: Subject to any disclaimer, the term of this patent is extended or adjusted under 35 U.S.C. 154(b) by 519 days.

(21) Appl. No.: 18/306,979

(22) Filed: Apr. 25, 2023

Related U.S. Application Data

(60) Provisional application No. 63/335,461, filed on Apr. 27, 2022.

(51) Int. Cl.

| | |
|---|---|
| ***B63B 21/20*** | (2006.01) |
| ***B63B 21/56*** | (2006.01) |
| ***B63B 21/66*** | (2006.01) |
| ***D07B 1/06*** | (2006.01) |
| ***D07B 1/14*** | (2006.01) |

(52) U.S. Cl.
CPC ..... *B63B 21/663* (2013.01); *B63B 21/20* (2013.01); *B63B 21/56* (2013.01); *D07B 1/0673* (2013.01); *D07B 1/14* (2013.01); *B63B 2021/203* (2013.01); *D07B 2201/2095* (2013.01); *D07B 2401/20* (2013.01); *D07B 2501/20* (2013.01)

(58) Field of Classification Search
CPC ..... B63B 21/00; B63B 21/20; B63B 21/56; B63B 21/663; B63B 2021/203; D07B 1/0673; D07B 1/14; D07B 2201/2095; D07B 2401/20
USPC ..... 114/254
See application file for complete search history.

(56) References Cited

U.S. PATENT DOCUMENTS

| | | | | |
|---|---|---|---|---|
| 3,440,992 A | | 4/1969 | Chance | |
| 3,809,334 A | * | 5/1974 | Beurer | B64D 1/22 242/390.8 |
| 3,895,595 A | * | 7/1975 | Kelly | B63B 21/663 114/243 |
| 4,700,651 A | | 10/1987 | Hale | |
| 5,275,120 A | | 1/1994 | Ruffa | |
| 6,244,204 B1 | | 6/2001 | Weyman | |

(Continued)

*Primary Examiner* — Lars A Olson
(74) *Attorney, Agent, or Firm* — Jesus J. Hernandez; U.S. Department of the Navy, Office of the General Counsel

(57) ABSTRACT

Example embodiments provide a reinforced fairing apparatus and method for hydrodynamic drag and vibration reduction. Example embodiments provide a reinforced fairing apparatus comprising a tow cable, a plurality of ribbons, and a plurality of stiffening elements. According to example embodiments, the tow cable may comprise strands of a metal arranged into at least one line and configured to be attached at each end. The plurality of ribbons may extend from at least part of the tow cable. Each ribbon may have at least one of the stiffening elements in a configuration throughout the length of the ribbon. The plurality of ribbons, aided by the stiffening elements, may be configured to be pliable during storage and streamlined with fluid flow during use. The plurality of stiffening elements may be a plurality of midribs.

8 Claims, 8 Drawing Sheets

(56) References Cited

U.S. PATENT DOCUMENTS

| | | | | |
|---|---|---|---|---|
| 10,254,422 | B2 | 4/2019 | Martin | |
| 10,286,983 | B1 | 5/2019 | Coakley | |
| 11,414,161 | B1 * | 8/2022 | Coakley | B63B 21/20 |
| 11,958,570 | B1 * | 4/2024 | Coakley | B63B 21/20 |
| 2017/0334526 | A1 | 11/2017 | Godøy | |

* cited by examiner

600

700

REINFORCED FAIRING APPARATUS AND METHOD FOR HYDRODYNAMIC DRAG AND VIBRATION REDUCTION

CROSS-REFERENCE TO RELATED APPLICATIONS

This application claims the benefit of U.S. Provisional Application No. 63/335,461 filed Apr. 27, 2022, titled "Reinforced Fairing Apparatus and Method for Hydrodynamic Drag and Vibration Reduction," incorporated herein by reference.

STATEMENT OF GOVERNMENT INTEREST

The following description was made in the performance of official duties by employees of the Department of the Navy, and, thus the claimed invention may be manufactured, used, licensed by or for the United States Government for governmental purposes without the payment of any royalties thereon.

TECHNICAL FIELD

The following description relates generally to marine cables.

BACKGROUND

Marine systems are usually towed from a vessel by a tow cable. Such systems usually produce hydrodynamic drag. Also, cable strumming may be caused by vortex induced vibration. These disruptions may be undesirable depending on operational requirements of a marine system. Applying fairing treatments on the tow cable can reduce undesired disruptions. Various fairing approaches exist to reduce normal hydrodynamic drag and cable strumming.

Hard fairing significantly reduces the normal hydrodynamic drag and cable strumming through the use of a high-density fairing shape over the tow cable. However, hard fairing requires substantial handling equipment when compared to other methods. This can be costly and bulky. For example, hard fairings require single-layer use on a drum to avoid deformations by a taught cable.

Hairy fairings are strings of hair woven in between strands of a steel armored tow cable. Unlike hard fairings, hairy fairing cables may be easily handled by handling equipment. However, hairy fairings are extremely flexible and flutter while under tow, occasionally knotting. Ribbon fairings are another alternative, but under the current state of the art such fairings create an undesired slapping phenomenon and have a tendency to be ripped off the cable or sustain damage.

SUMMARY

Example embodiments provide a reinforced fairing apparatus comprising a tow cable, a plurality of ribbons, and a plurality of stiffening elements. According to example embodiments, the tow cable may comprise strands of a metal arranged into at least one line and configured to be attached at each end. The plurality of ribbons may extend from at least part of the tow cable. Each ribbon may have at least one of the stiffening elements in a configuration throughout the length of the ribbon. The plurality of ribbons, aided by the stiffening elements, may be configured to be pliable during storage and streamlined with fluid flow during use. The plurality of stiffening elements may be a plurality of midribs.

BRIEF DESCRIPTION OF DRAWINGS

The accompanying figures are included to provide a further understanding of example embodiments, and are incorporated in and constitute part of this specification. In the figures.

DETAILED DESCRIPTION

In the following description, for purposes of explanation and not limitation, specific details are set forth such as particular structures, designs, techniques, etc., in order to provide a thorough understanding of the example embodiments. However, it will be apparent to those skilled in the art that the disclosed subject matter may be practiced in other illustrative embodiments that depart from these specific details. In some instances, detailed descriptions of well-known elements and/or method are omitted so as not to obscure the description with unnecessary detail. All principles, aspects, and embodiments, as well as specific examples thereof, are intended to encompass both structural and functional equivalents of the disclosed subject matter. Additionally, it is intended that such equivalents include both currently known equivalents as well as equivalents developed in the future.

The following description refers to an apparatus and method for reducing hydrodynamic drag and vibration through use of a reinforced fairing apparatus. However, it should be noted that the example embodiments shown and described herein are meant to be illustrative only and not limiting in any way. As such, various modifications will be apparent to those skilled in the art for application to marine tow systems based on technologies other than the above, which may be in various stages of development and intended for future replacement of, or use with, the above described method or apparatus.

Figure 1:
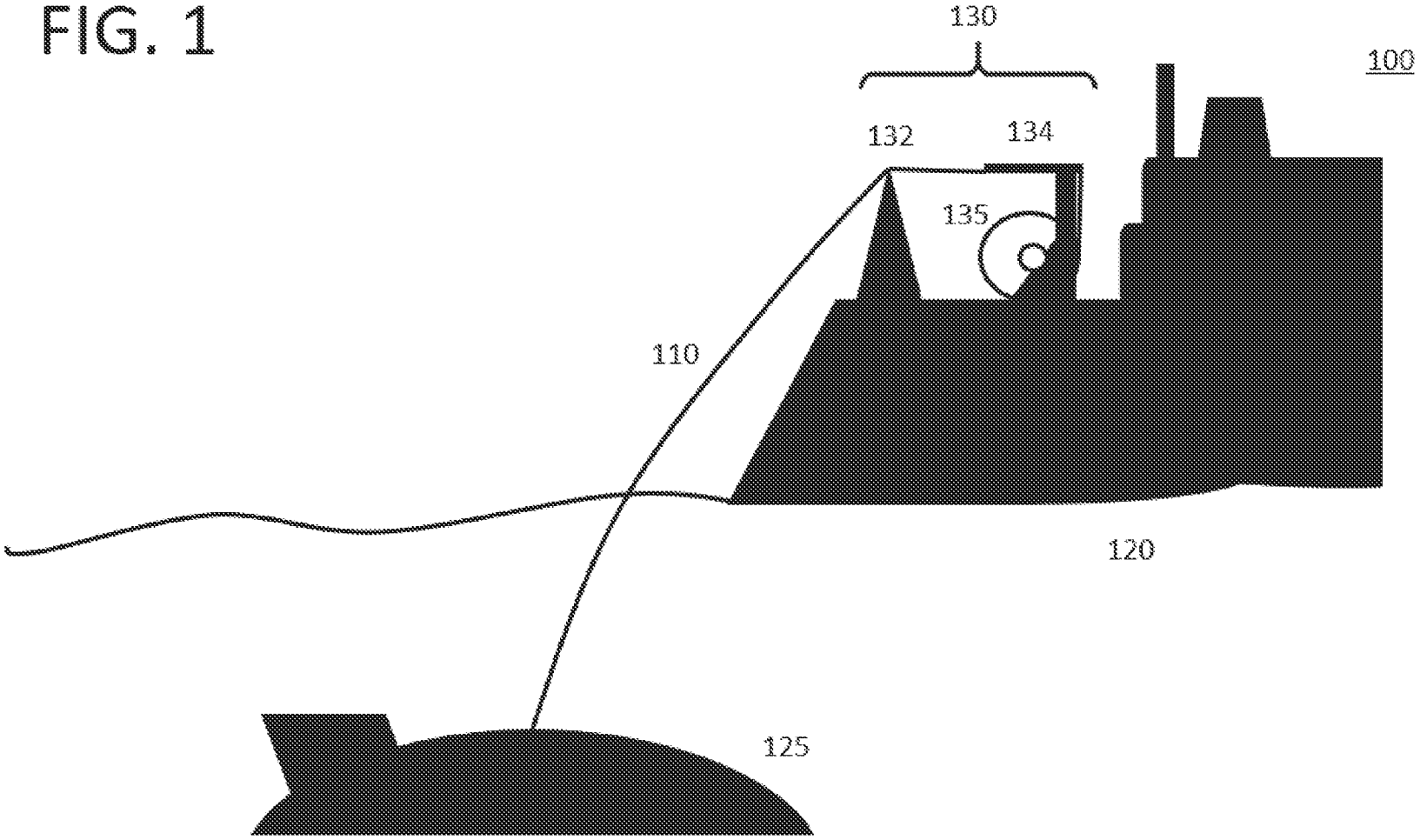
FIG. 1 is an example marine tow system arrangement.

FIG. 1 is an example marine tow system arrangement 100. The example marine tow system arrangement 100 may include handling equipment 130. The handling equipment may comprise a drum 135 that stores the tow cable 110 by rolling up the line. A levelwind 134 may be connected to the drum 135. The levelwind 134 guides the tow cable 110 out of the drum 135 in a desired fashion. The tow cable 110 may go through a streaming sheave 132 to facilitate the deposit of the tow cable 110 into a body of water. The tow cable 110 may be connected to a tow body 125 that is towed through the body of water by a vessel 120. The body of water may be an ocean, a lake, a river, and/or a bay. The tow cable 110 may be segmented, connected at various nodes.

Tow cable 110 may produce undesired disruptions during operation of the marine tow system 100. These disruptions may include hydrodynamic drag and cable strumming. Tow cable 110 may be treated with fairings to reduce these disruptions. Fairing treatments may include ribbon fairing, hard fairing, and hairy fairing, but each has its own shortcomings. Hard faring require substantial handling equipment. Hairy fairings flutter while under tow and occasionally knot. Ribbon fairings create an undesired slapping phenomenon and can rip or sustain damage. The goal of the invention is to reduce the vibration and hydrodynamic drag of a tow cable 110.

Figure 2:
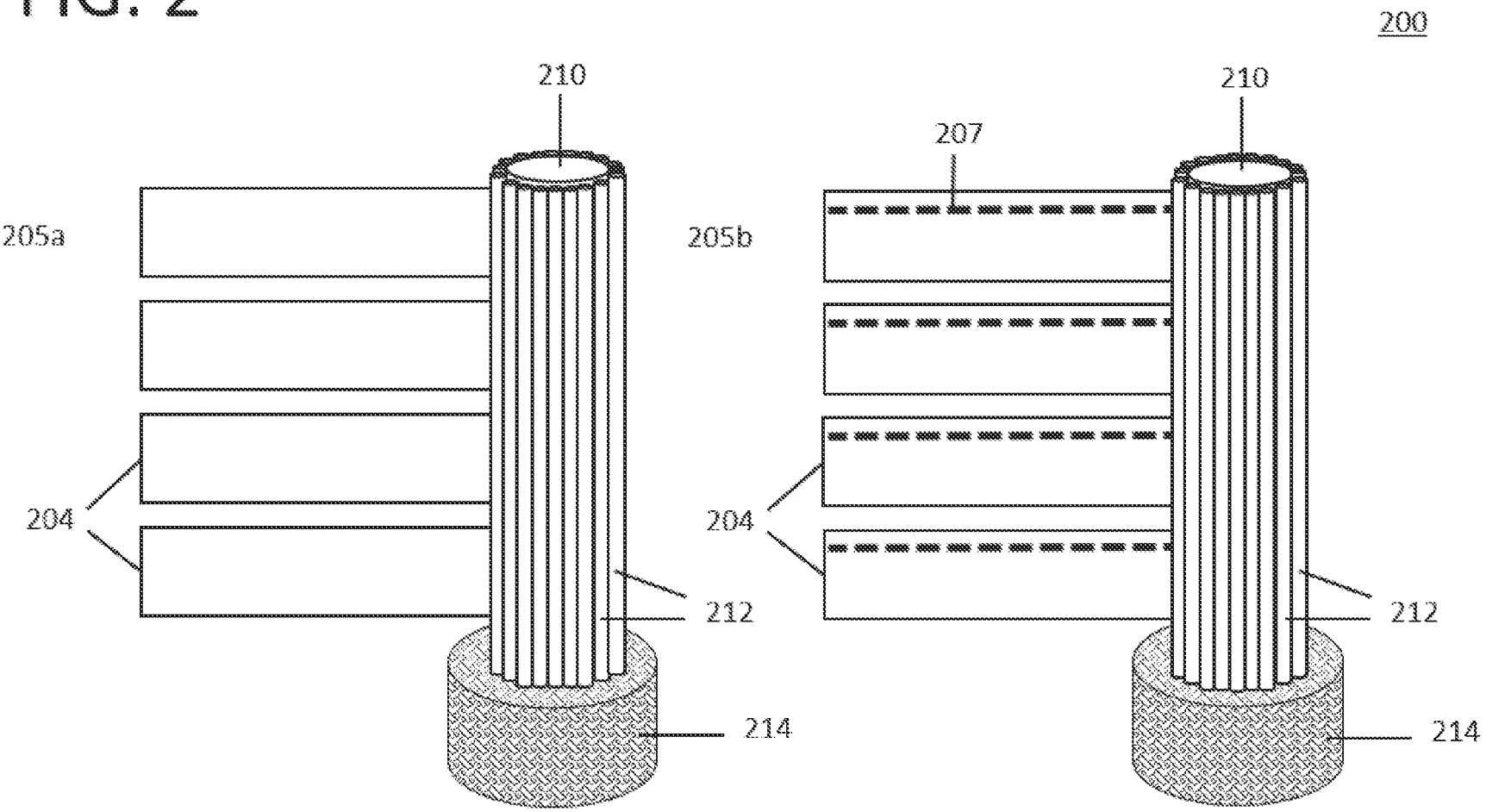
FIG. 2 is a comparison of the ribbons of a fairing apparatus and a reinforced fairing apparatus according to an example embodiment.

FIG. 2 is a comparison 200 of the ribbons of a fairing apparatus 205*a* and a reinforced fairing apparatus 205*b* according to an example embodiment. Both the fairing apparatus 205*a* and the reinforced fairing apparatus 205*b* implement ribbon fairing treatments. In example embodiments, ribbon fairing reduces hydrodynamic drag and cable strumming by weaving a plurality of ribbons 204 between the strands 212 of a tow cable 210 to streamline the shape of the cable. The ribbons 204 may be a thin sheet. The ribbons 204 may be made of polyurethane, rubber, or any other material of high tensile strength and flexibility. The tow cable 210 may be made of stainless steel. The tow cable 210 may also have an additional coating 214. The additional coating may be a fabric material, additional strands of steel or other metal, and/or a material coating layer.

A tow line 210 with ribbon fairings may be easily operated by handling equipment in a marine tow system arrangement. Ribbons 204 are flexible and pliable. This can facilitate multiple wraps of the tow cable 210 on a drum. Furthermore, while under tow, the fairings created by ribbons 204 streamline the cable in the direction of the tow and reduce shedding vortices that cause cable strumming.

Notably, the fairing apparatus 205*a* flutter in the flow field due to the flexibility of the fairing. This creates an undesired slapping phenomenon. The configuration of ribbons 204 in fairing apparatus 205*a* also have a tendency to be ripped off the cable or sustain damage to the shape (rips, tears, etc.) after being exposed to handling gear and flow field multiple times.

In view of the shortcomings of fairing apparatus 205*a*, a reinforced fairing apparatus 205*b*, according to an example embodiment of the invention, allows the stiffness of the ribbon 204 to be significantly increased by the addition of midribs 207, a stiffening element. The midribs 207 reduce the flutter, flapping, and/or undesired slapping phenomenon of the ribbon 204. This concept is borrowed from nature, where the midribs and veins of a leaf reduce the flutter and flapping in the wind.

The increased stiffness of the reinforced fairing apparatus 205*b* will make the tow cable 210 more rigid and streamlined. Also, the increased stiffness of the reinforced fairing apparatus 205*b* moves the natural frequency of the tow cable 210 away from the vortex sheading frequencies experienced at operations speeds. The midribs 207 may allow the ribbons 204 to still remain flexible, maintaining the tow cable 210's ability to traverse handling equipment and have multiple rolling wraps in a drum. Furthermore, once the tow line 210 is uncoiled and exposed to a flow field, the fairing apparatus 205*b* may still take a streamlined shape.

The midrib 207 may be added into the ribbons 204 through various processes. In one example embodiment, the midribs 207 may be added by embedding into the body of a strand of ribbon 204. This approach may be preferred when the composition of ribbon 204 is a material that can temporarily become viscous with an appropriate amount of heat (i.e., melt), such as polyurethane. In alternative example embodiments, the midrib 207 may be adhered on top of each ribbon 204 (as opposed to embedded within it). For instance, the midrib 207 may be added using an adhesive that can maintain properties during use in a body of water, such as an epoxy.

The midrib 207 may have various configurations and/or patterns to optimize the ability of the reinforced fairing apparatus 205*b* to perform in different operational environments. The midrib 207 may be embedded within each ribbon 204 in a straight line. In some example embodiments, the midrib 207 may be embedded in some of the ribbons 204 in a desired pattern, such as in an alternating fashion, or in a section of ribbons 204 in the tow cable 210 that is subject to a stronger flow field.

The material and stiffness of the midrib 207 may also be selected based on operational realities or cost. The midribs 207 may be made of steel wire. In alternative embodiments, the midribs 207 may use other small diameter wire materials such as solder, copper wire, fiberglass, and/or carbon fiber to allow the reinforced fairing apparatus 205*b* to achieve a stiffer constitution.

The midrib 207 may also have different patterns. In some example embodiments, the midrib 207 may be split in half longitudinally. This may prevent the loss of ribbons 204 during normal operation by having the diameter of the midrib 207 be larger than the gaps between strands 212—preventing ribbons 204 from being pulled out. Additional discussion on the various configurations of the midribs is provided in FIG. 7.

Figure 3:
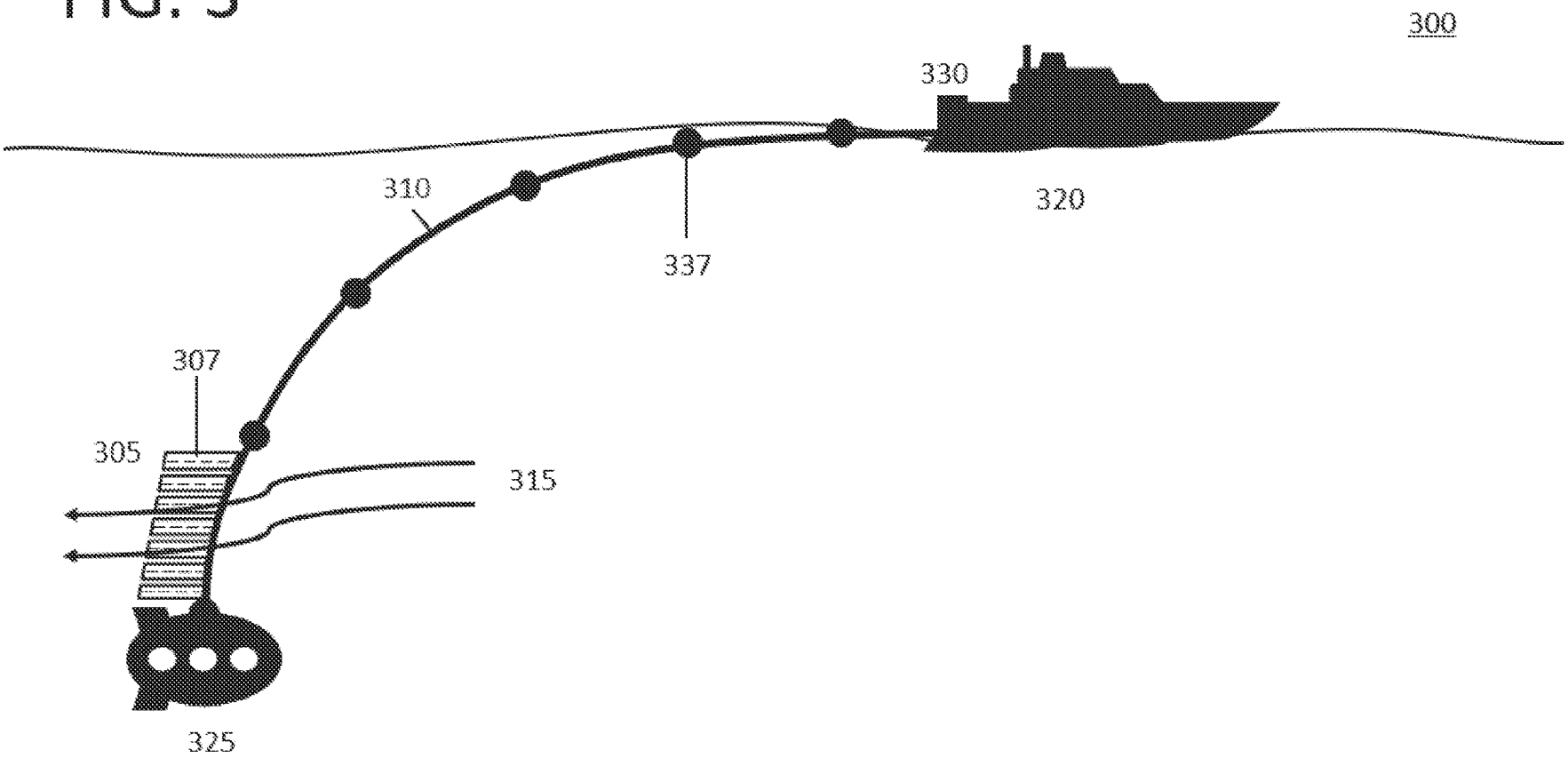
FIG. 3 is a reinforced fairing apparatus according to an example embodiment in an example marine tow system.

FIG. 3 is a reinforced fairing apparatus 300 according to an example embodiment in an example marine tow system. In this example embodiment, a vessel 320 may transport handling equipment 330. The handling equipment may comprise the constituent components illustrated in FIG. 1. A tow line 310 may comprise various segments separated by nodes 337 and connected to a tow body 325. In this example, most of the segments of the tow line 310 are bare cables, and the final segment of the tow line 310 is a reinforced fairing apparatus 305. The number of tow line 310 segments may be adjusted based on the operational conditions in which the marine tow system is in. The number of tow line 310 may also be adjusted based on other factors such as resources and costs. In alternative example embodiments, the tow line 310 may be entirely made up of segments of the reinforced fairing apparatus 305. In other example embodiments, the tow line 310 may be a single continuous line of a reinforced fairing apparatus 305.

The ribbons in the reinforced fairing apparatus 305 include a midribs 307. A flow field 315 traverses the fairing apparatus 305 in a streamlined fashion. The flow field may be different depending on situational conditions, such as type of body of water, depth of the tow body 325, composition of the tow cable 310, speed of the vessel 320, and/or turbulence or other maritime/ambient conditions.

Figure 4:
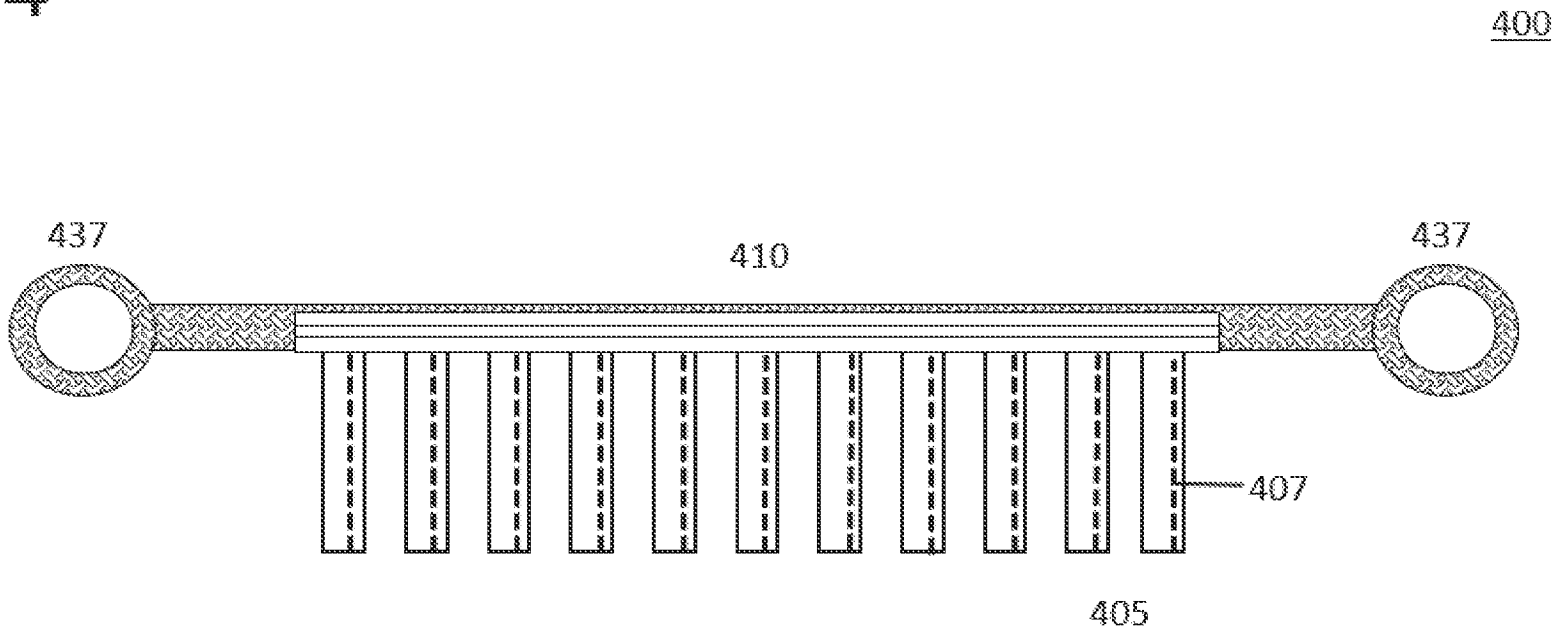
FIG. 4 is a reinforced fairing apparatus according to an example embodiment.

FIG. 4 is a reinforced fairing apparatus segment 400 according to an example embodiment. The reinforced fairing apparatus segment 400 may include end nodes 437 that can connect to other end nodes 437, a vessel, and/or a two body. A tow cable segment 410 connects the two end nodes 437. The tow cable segment 410 may be made of stainless steel and comprise strands. The tow cable 410 includes reinforced fairing apparatus 405. The reinforced fairing apparatus 405 comprises multiple ribbons that may be weaved between strands of the tow cable 410. Each ribbon includes a midrib 407 according to example embodiments. The number of ribbons in the reinforced fairing apparatus 405 may be dependent on operational conditions or resources. FIG. 4 illustrates eleven (11) ribbons in the reinforced fairing apparatus 405, but this number can be substantially higher for a single reinforced fairing apparatus segment 400. Furthermore, the configuration of the ribbons may be different, such as having a set on each side of the tow cable segment 405.

Figure 5:
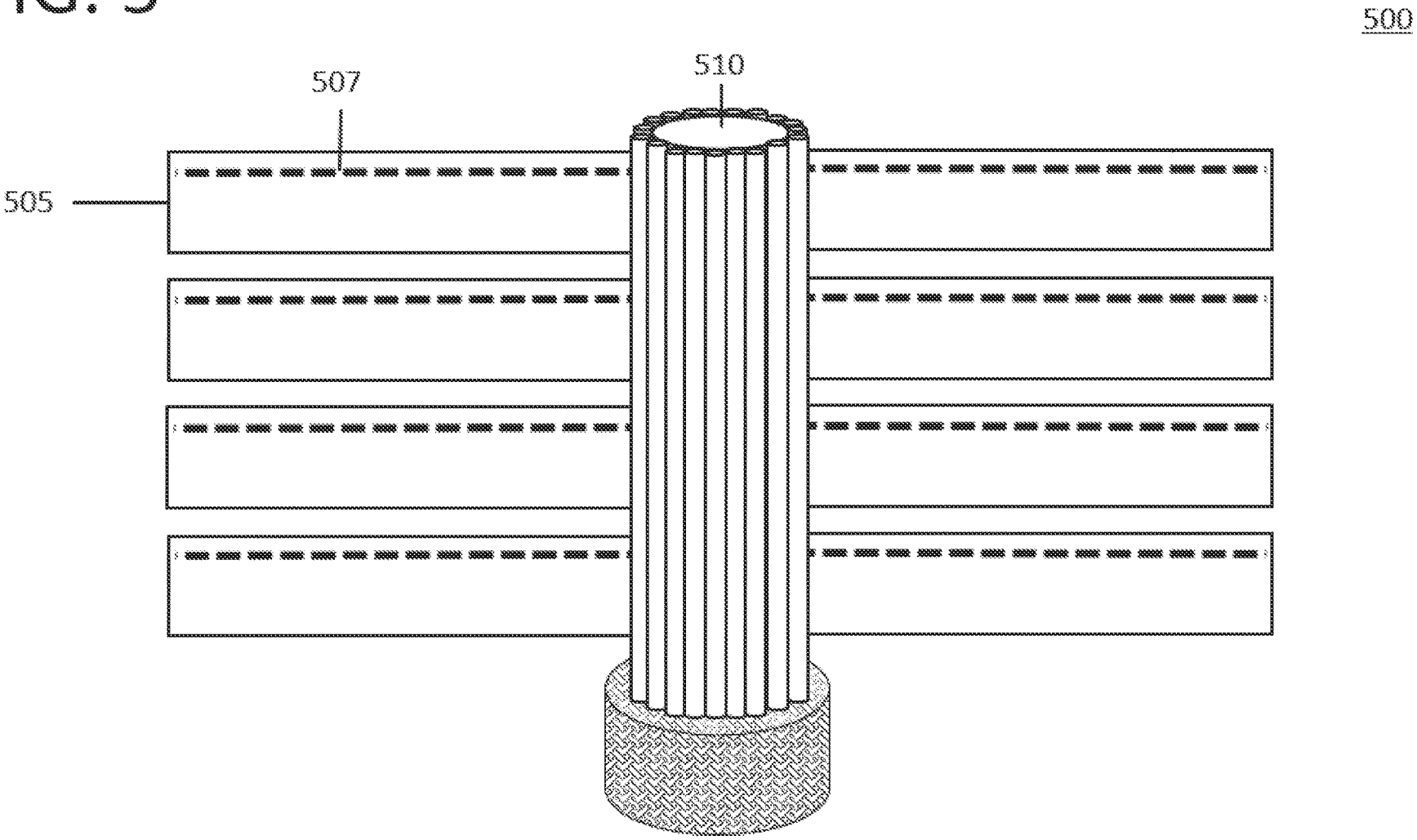
FIG. 5 is a reinforced fairing apparatus segment with two sets of ribbons according to an example embodiment.

FIG. 5 is a reinforced fairing apparatus 500 with two sets of ribbons 505 according to an example embodiment. Each set of ribbons 510 may be at opposite sides of a tow cable 510. Each ribbon includes a midrib 507 according to example embodiments of the invention. In this example embodiment, the ribbons 505 extend perpendicular to the tow cable 510. In alternative example embodiments, the ribbons 505 in the reinforced fairing apparatus 500 can extend at obtuse or acute angles from the tow cable 510.

In addition, the ribbons 505 can be configured in different shapes. FIG. 5 illustrates ribbons 505 in a rectangular ribbon shape. In alternative example embodiments, the ribbons 505 may be in a tapering shape, triangular shape, leaf shape, fin shape, or other shape that minimizes hydrodynamic drag and cable strumming. The shape of the ribbon may be selected to complement the arrangement or configuration of the midrib 507.

Figure 6:
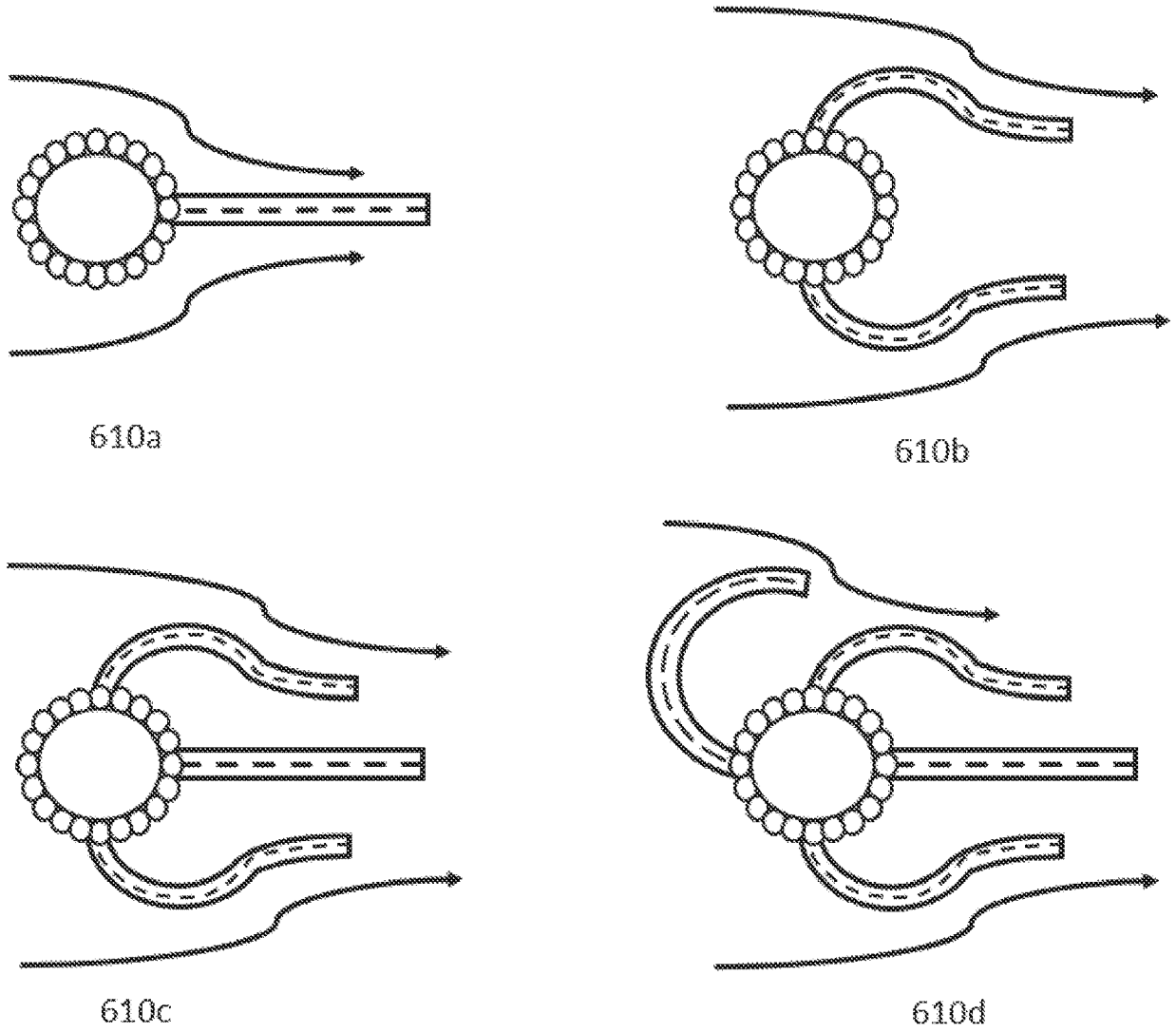
FIG. 6 is a top-view illustration of fluid flow in various example embodiments of the reinforced fairing apparatus.

FIG. 6 is a top-view illustration 600 of fluid flow in various example embodiments of the reinforced fairing apparatus. Reinforced fairing apparatus 610*a* comprises ribbons in a single side of a tow cable. As the ribbons are at a single side of the tow cable, the top-view cross-sectional view of FIG. 6 shows a single ribbon. The fluid flow arrows illustrate how the ribbons in the reinforced fairing apparatus 610*a* become streamlined. The ribbon appears straight as a result. The midrib prevents slapping by the ribbon.

The reinforced fairing apparatus 610*b* comprises ribbons in two sides of a tow cable. The top-view cross-sectional view of FIG. 6 shows two ribbons. The fluid flow arrows illustrate how the ribbons in the reinforced fairing apparatus 610*b* become streamlined. In this example embodiments, the ribbons bend as a result of the fluid flow. The bending of the ribbons is complemented by the midribs according to example embodiments of the invention. Reinforced fairing apparatus 610*c* and reinforced fairing apparatus 610*d* comprises ribbons in three and four sides, respectively.

Figure 7:
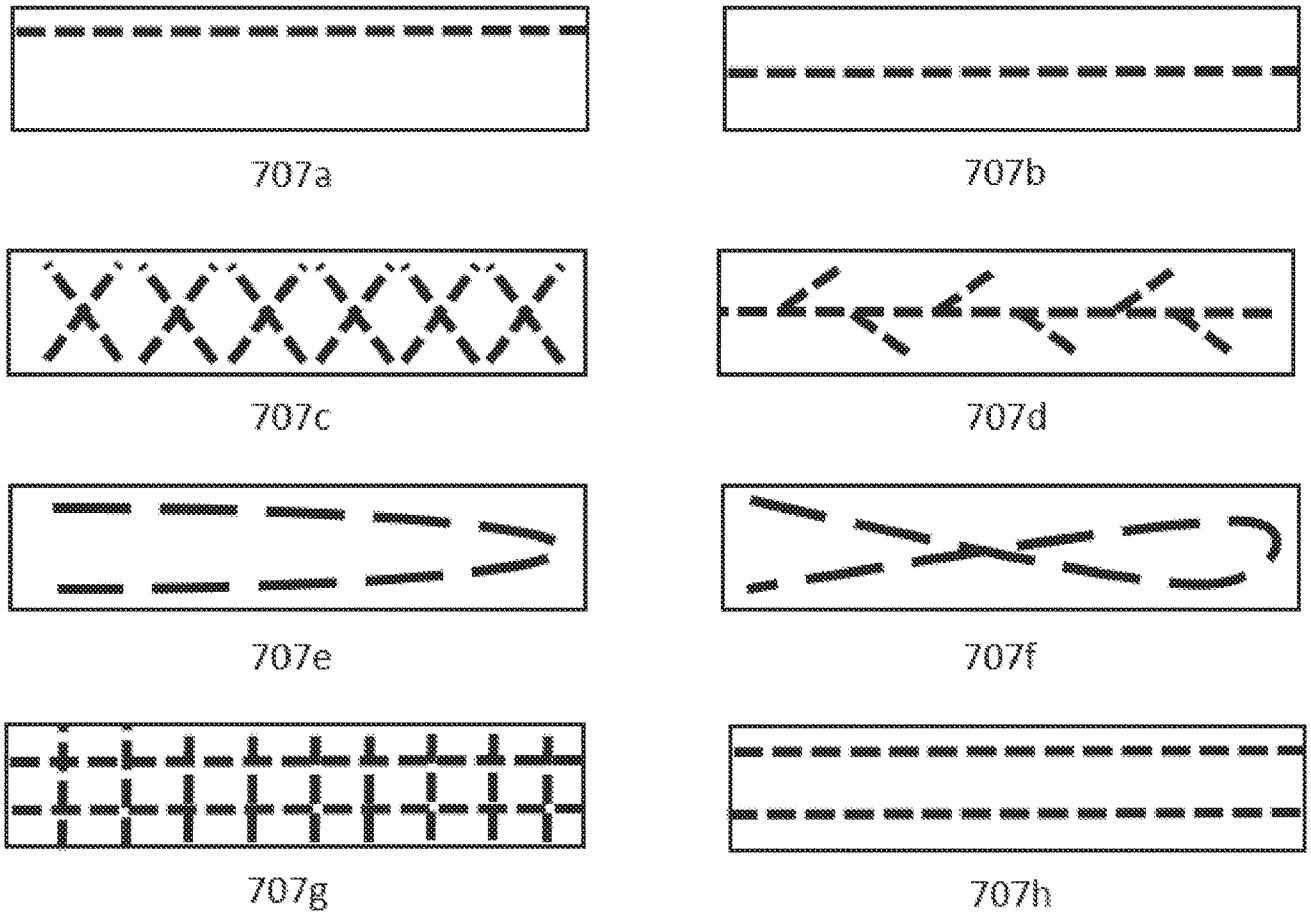
FIG. 7 is a set of ribbons for a reinforced fairing apparatus according to various example embodiments.

FIG. 7 is a set of ribbons 700 for a reinforced fairing apparatus according to various example embodiments. The midribs associated with ribbons in a reinforced fairing apparatus may have different configurations and/or patterns. The various configuration and/or patterns may be selected to optimize the ability of the reinforced fairing apparatus to perform in different operational environments. Ribbon 707*a* has a midrib across the top section of the ribbon length. Ribbon 707*b* has a midrib across the middle section of the ribbon length. Ribbon 707*c* has a x-shaped midrib lines repeating throughout the ribbon length. Ribbon 707*d* has a midrib across the mid section of the ribbon length, with protruding lines from the mid section line. Ribbon 707*h* has two midrib lines traversing the ribbon.

In more creative approaches, ribbon 707*e* has a single crescent midrib line running across the entire ribbon length. Ribbon 707*f* comprises a single midrib line folding and intersecting in a single x-shape. Finally, ribbon 707*g* is a checkered intersection of a plurality of midrib lines throughout the entire ribbon length. The example ribbons illustrated are non-exhaustive and alternative example embodiments may be used.

Figure 8:
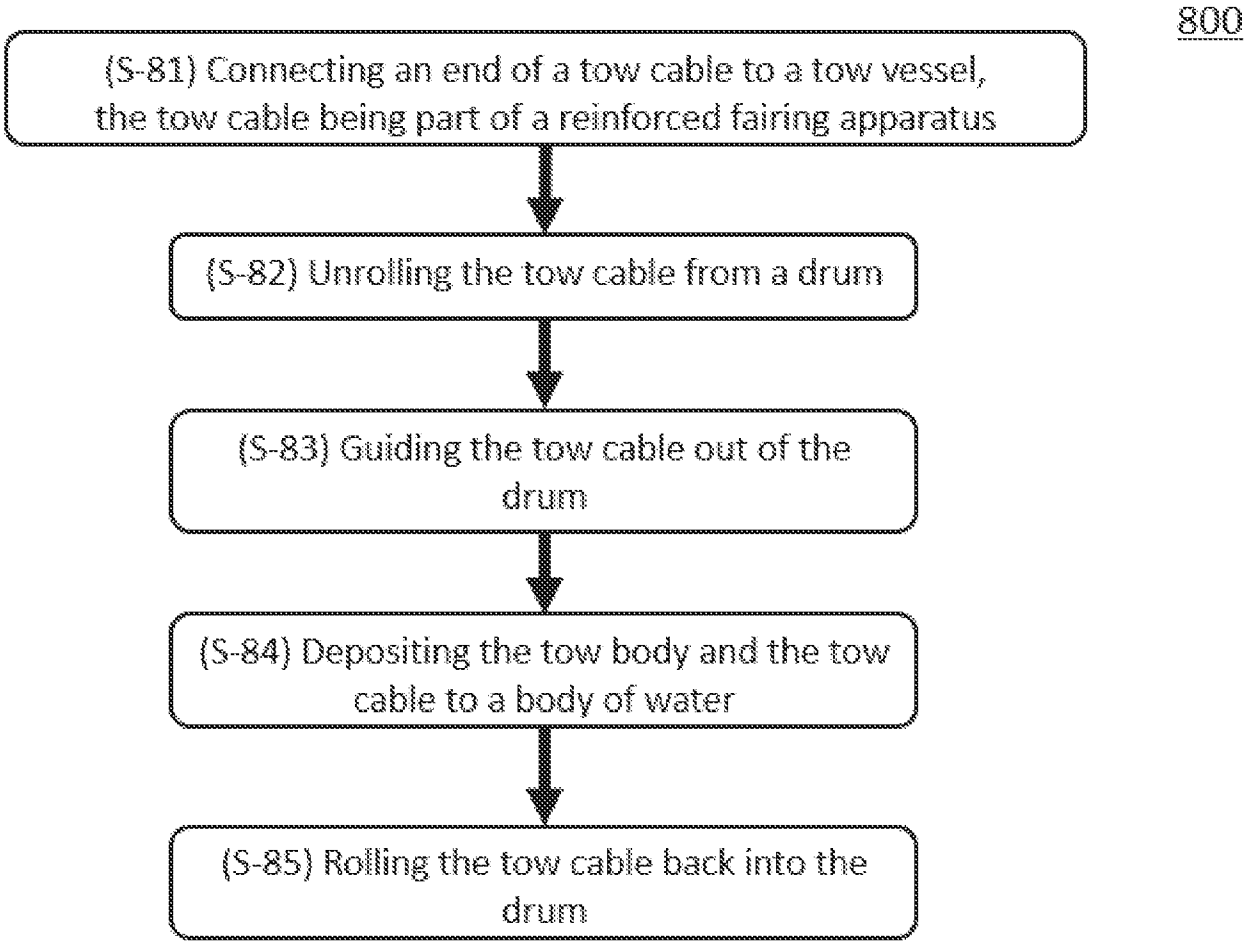
FIG. 8 is a disruption reduction method according to example embodiments.

FIG. 8 illustrates a disruption reduction method 800 according to example embodiments. The disruption reduction method 800 reduces drag and vibration. The initial step (S-81) is connecting an end of a tow cable to a tow vessel. The tow cable may be a reinforced fairing apparatus according to example embodiments. More specifically, the tow cable may comprise metal strands arranged into one or more lines. The tow cable may be configured to be attached at each end. Furthermore, the tow cable comprises a plurality of ribbons. The ribbons may extend from at least part of the tow cable.

The next step is (S-82) unrolling a tow cable from a drum. Notably, each ribbon includes a midrib acting as a stiffening element. Each midrib may be configured to traverse the entire length of a ribbon. Next, (S-83) the tow cable is guided out of the drum alongside the plurality of ribbons on the tow cable. This may be performed with the assistance of a levelwind.

In order to operate the reinforced fairing apparatus, the next step is (S-84) depositing the tow body and the tow cable into a body of water. In this case, the plurality of ribbons, aided by the midribs, may be streamlined with fluid flow in the body of water. The fluid flow may be caused by the movement of a vessel to which the tow cable and drum a connected. Finally, the tow cable may be (S-85) rolled back into the drum when operation is done. The ribbons of the tow cable, even though supported by the midribs, are nonetheless pliable and facilitate storage into the drum.

The example embodiments being thus described, it will be obvious that the same may be varied in many ways. Such variations are not to be regarded as a departure from the disclosed subject matter, and all such modifications are intended to be included within the scope of the disclosed subject matter.

What is claimed is:

1. A reinforced fairing apparatus comprising:

a tow cable comprising strands of a metal arranged into at least one line and configured to be attached at each end;

a plurality of ribbons extending from at least part of the tow cable; and a plurality of stiffening elements, wherein each ribbon has at least one of the stiffening elements in a configuration throughout the length of the ribbon;

wherein the plurality of ribbons, aided by the stiffening elements, is configured to be streamlined with fluid flow during use, wherein the plurality of ribbons is configured to be pliable, wherein the plurality of stiffening elements are a plurality of midribs, wherein each midrib in the plurality of midribs is at least a single line across a ribbon in the plurality of ribbons, and wherein for each ribbon of the plurality of ribbons, the ribbon comprises one of the single line of the midrib curved into a crescent shape, a first set of midrib lines formed into a checkered intersection, or a second set of midrib lines formed into a repeating x-shape pattern.

2. The reinforced fairing apparatus of claim 1, wherein the plurality of midribs are embedded into the plurality of ribbons prior to incorporation into the strands.

3. A marine tow system comprising:

a reinforced fairing apparatus comprising a tow cable made up of strands of a metal arranged into at least one line and configured to be attached at each end, a plurality of ribbons extending from at least part of the tow cable, a plurality of stiffening elements, wherein each ribbon has at least one of the stiffening elements in a configuration throughout the length of the ribbon;

equipment configured to handle the tow cable, store the tow cable, and facilitate deposit of the tow cable;

a water borne element providing structural support to the equipment;

wherein the plurality of ribbons, aided by the stiffening elements, is configured to be streamlined with fluid flow during use, wherein the plurality of ribbons is configured to be pliable, wherein the plurality of stiffening elements are a plurality of midribs, wherein each midrib in the plurality of midribs is at least a single line across a ribbon in the plurality of ribbons, and wherein for each ribbon of the plurality of ribbons, the ribbon comprises one of the single line of the midrib curved into a crescent shape, a first set of midrib lines formed into a checkered intersection, or a second set of midrib lines formed into a repeating x-shape pattern.

4. The marine tow system of claim 3, wherein the plurality of midribs are embedded into the plurality of ribbons prior to incorporation into the strands.

5. The marine tow system of claim 3, wherein the equipment comprises at least a drum storing the tow cable, a levelwind guiding the tow cable out of the drum, and a streaming sheave facilitating deposit of the tow cable to a body of water.

6. The marine tow system of claim 3, wherein the water borne element is a vessel.

7. The marine tow system of claim 3, wherein the tow cable is attached to a tow body.

8. A disruption reduction method comprising:

connecting an end of a tow cable to a tow vessel, wherein the tow cable comprises strands of a metal arranged into at least one line and configured to be attached at each end;

unrolling the tow cable from a drum, wherein the tow cable comprises a plurality of ribbons extending from at least part of the tow cable, and a plurality of stiffening elements such that each ribbon of the plurality of ribbons has at least one of the plurality of the stiffening elements in a configuration throughout the length of the ribbon;

guiding the tow cable out of the drum alongside the plurality of ribbons on the tow cable;

depositing a tow body and the tow cable into a body of water, wherein the plurality of ribbons, aided by the stiffening elements, is streamlined with fluid flow; and rolling the tow cable back into the drum, wherein the plurality of ribbons is configured to be pliable to facilitate storage into the drum wherein the plurality of stiffening elements are a plurality of midribs, wherein each midrib in the plurality of midribs is at least a single line across a ribbon in the plurality of ribbons, and wherein for each ribbon of the plurality of ribbons, the ribbon comprises one of the single line of the midrib curved into a crescent shape, a first set of midrib lines formed into a checkered intersection, or a second set of midrib lines formed into a repeating x-shape pattern.

* * * * *